United States Patent [19]

Michael

[11] 4,287,874

[45] Sep. 8, 1981

[54] COAL AND ASH CADDY

[76] Inventor: Edgar E. Michael, Rte. 1, Box 404A, Verona, Va. 24482

[21] Appl. No.: 86,252

[22] Filed: Oct. 18, 1979

[51] Int. Cl.[3] ..... F23J 1/00; B65D 88/00

[52] U.S. Cl. ..... 126/242; 220/2; 220/93

[58] Field of Search ..... 220/2, 93; 126/245

[56] References Cited

U.S. PATENT DOCUMENTS

| | | | |
|---|---|---|---|
| 43,916 | 8/1864 | Jeffery | 220/2 |
| 362,616 | 5/1887 | Freudenberg | 220/2 |
| 1,470,205 | 10/1923 | Vogt | 220/2 |
| 1,957,097 | 5/1934 | Dalen | 220/2 |
| 2,296,215 | 9/1942 | Layher | 220/93 |
| 3,318,300 | 5/1967 | Witty | 126/245 |

FOREIGN PATENT DOCUMENTS

| | | | |
|---|---|---|---|
| 387891 | 4/1961 | Switzerland | 126/245 |

*Primary Examiner*—Samuel Scott
*Assistant Examiner*—Wesley S. Ratliff, Jr.
*Attorney, Agent, or Firm*—Blair, Brown & Kreten

[57] ABSTRACT

Disclosed herein is a coal and ash caddy defined by a container having a plunger plate disposed therewithin having a contour complimental to the inner configuration of the container, a plunger rod connected to the plate extending outwardly through the container terminating in a handle, and a support framework fastened to the container connected to a door on one open end of the caddy so that manipulation of the support frame will cause the door to open and manipulation of the plunger handle will cause the plunger plate to eject a quantity of fuel to be ejected from the container. Similarly, the device can be manipulated to allow the introduction of ashes from a stove or the like whereby the ashes can be removed from the building within which the stove is provided without desiminating ashes in the environment.

9 Claims, 5 Drawing Figures

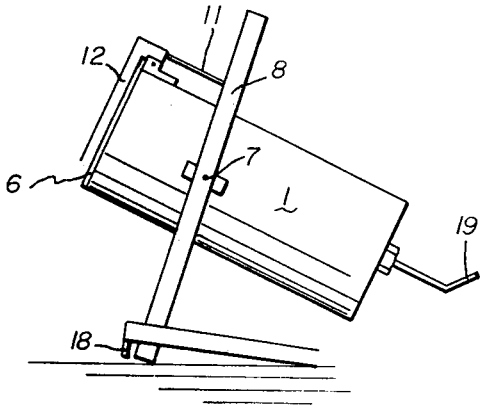
FIG. 1
FIG. 2
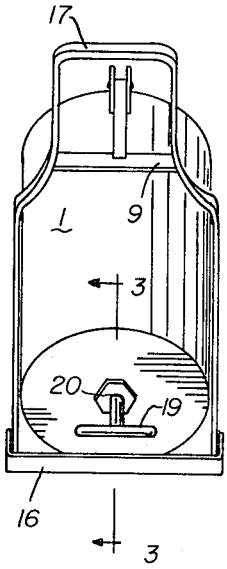
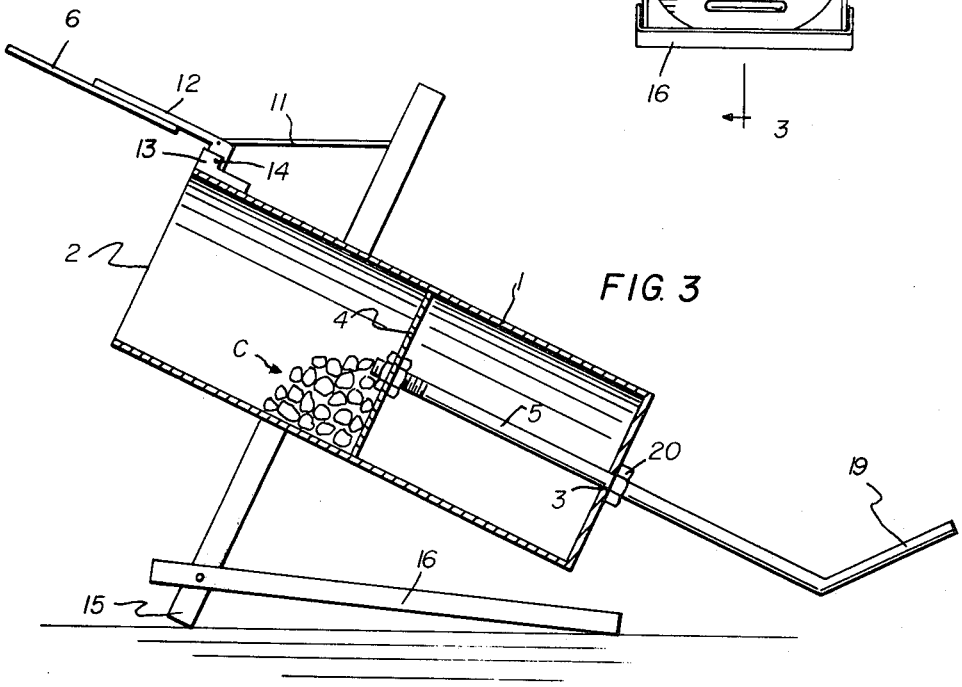
FIG. 3
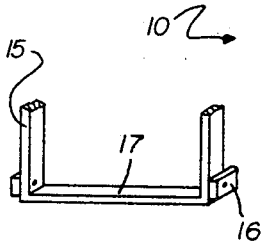
FIG. 5
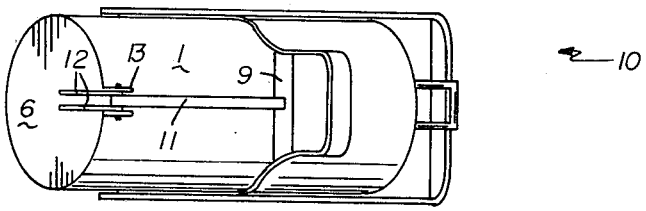
FIG. 4

COAL AND ASH CADDY

BACKGROUND OF THE INVENTION

With the advent of using renewable resources to provide heat such as wood, and the like, the existence of stoves and heaters requiring these fuels has provided for a substantial demand for a device which can store hot ashes in a safe environment, or conveniently discharge fuel such as coal within the stove without providing contamination of the surrounding area as by coal dust or ashes and the like.

In this regard, the following patents appear to reflect the most relevant prior art of which the inventor is aware since these devices relate generally to articles which may be used in a similar fashion:

U.S. Pat. No. 43,016; Jeffrey;
U.S. Pat. No. 119,738; Bragaw;
U.S. Pat. No. 141,485; Brown;
U.S. Pat. No. 185,961; Pratt;
U.S. Pat. No. 362,616; Freudenberg;
U.S. Pat. No. 398,410; Laude.

Of these references, the patent to Jeffrey appears to be closest since he teaches the use of a coal hod having a lid (a) and a crank operated screw (b) used to advance the coal.

The remaining references show the state of the art further and it should be appreciated that those similarities between these references and that which is about to be delineated are merely coincidental since these prior art devices do not appear to provide the same reliability in construction, or the facility in use.

SUMMARY OF THE INVENTION

Accordingly, a primary object of this invention is to provide a coal and ash caddy which is durable in construction, relatively easy to manufacture, and easy to operate with coal cubes up to seven inches in diameter, depending on the manufacturer's size of the cylinder.

Another object is to provide a device of the character described above in which a support frame serves as an integral part of the container and simultaneously when manipulated actuates the door mechanism of the container. This feature, of course, allows the contents to be transferred into or out of the coal and ash caddy without placing one's hands objectionally close to the existing fire thereby obviating a potential hazard.

A further object is to provide a mechanism of the character described above which can store hot ashes for a reasonable period so that they do not have to be placed in an environment where they may cause an inadvertent fire.

These and other objects will be made manifest when considering the following detailed specification when taken in conjunction with the appended drawing figures.

BRIEF DESCRIPTION OF THE DRAWINGS

FIG. 1 is a side view of the apparatus according to the present invention.

FIG. 2 is a top perspective view of the apparatus shown in FIG. 1.

FIG. 3 is a sectional view taken lines 3—3 of FIG. 2.

FIG. 4 is a top plan view of that which is shown in FIG. 3.

FIG. 5 is a detailed parts view of a bottom portion of the device according to the present invention.

BRIEF DESCRIPTION OF THE PREFERRED EMBODIMENT

Referring to the drawings now, wherein like reference numerals refer to like parts throughout the several drawing figures, reference numeral 10 is directed to the coal and ash caddy according to the present invention. This caddy 10 may generally be regarded as being provided with a container 1 having a generally cylindrical configuration provided with an open end 2, a closed end having an aperture 3 through which a rod 5 is disposed. The rod 5 is threadably connected as by nut elements to a plunger plate 4 having an external configuration complimental to the cross-section of an inner portion of the container so that a snug fit is existing between the container and the plunger plate 4. A terminal portion of the plunger rod 5 remote from the plunger plate 4 is fashinoned into a handle 19 which in one form (FIG. 2) is a T-shaped handle, and as shown in FIGS. 3 or 4 defines a substantially U-shaped handle.

In any event, coal C disposed within container 1 can easily be ejected therefrom when the door 6 is opened by a support means now to be defined.

The support means which actuates the door 6 is comprised substantially of two parallel rod members 8 disposed on opposed sides of the container pivoted thereto as by 7 so that the pivot on opposed sides of the container forms an axis. The parallel support rods 8 have on a top face of the container thereof a transverse link 9 extending therebetween, and a follower bar 11 is connected to the transverse link 9 by means of a "J" shaped hook at a terminal of the follower bar 11. This hook resides of course in an appropriately fashioned hole or slot in the transverse link 9. The terminal portion of the follower bar 11 remote from the transverse link 9 is pinned or pivoted to at least one L-shaped flange element 12 in which the longer leg thereof is affixed to the door 6 and the shorter leg of which connects to a lip of the container 1 proximate to the door by means of a pair of spaced upstanding ears 13 having a pivot pin 14 extending therethrough. The L-shaped flange element is placed between the ears and pinned therebetween. As shown in the preferred embodiment of FIG. 4, a pair of spaced parallel L-shaped flange elements 8 are provided.

The terminal portions of spaced parallel support rods 8 are provided with a crossbrace 17 at the extremities thereof, and at the lower extremities (FIG. 5) the terminal portions of the parallel support rods 8 define feet 15. At the terminal portion near feet 15 there is provided a further brace defined by a U-shaped support brace 16 having its open end fastened to the rods 8 at the terminus 15 as shown in FIG. 5. FIG. 1 details the structure in which the support base 16 is provided with a stop element 18 so that since the support base 16 is pivoted to the feet 15, it can be rotated and made to be coincident with a portion of the upper body of the container at least to the extent permitted by the stop element 18. FIG. 3 shows that the aperture 3 extending through a back wall of the container 1 has a nut 20 on the outer face thereof to serve as a guide for the plunger rod 5 and this nut, denoted by reference numeral 20, may be suitably affixed to the container as by welding.

Further, it should be apparent that numerous structural modifications are contemplated as being a part of this invention as set forth herein above and as defined herein below by the claims.

What is claimed is:

1. A coal and ash caddy comprising in combination:

a container of uniform cross-section having an open end at one extremity thereof and an aperture at a closed end opposite from said open end, a plunger plate disposed within said container having a configuration complemental to said uniform cross section of said container, a plunger rod connected to said plunger plate, said rod extending through said aperture to push the contents within said container outside said open end by coaction of said plunger plate against the contents, support means pivotally disposed on an outer portion of said container about an axis, said support means having door means overlying said open end, and door-control means operatively connected to said support means whereby when said container is pivoted about said axis relative to said support means said door means opens and closes said open end and said support means simultaneously keeps said container suspended so as to prevent heat from ashes and the like from contacting the surface supporting said caddy.

2. The device of claim 1 wherein said support means comprises a pair of spaced parallel rods pivoted to opposed sides of said container and extending to a supporting surface below said container, a transverse link extending between said rods, a follower bar connecting said transverse link and said door means.

3. The device of claim 2 including door means defined by a door plate complimentally formed to close said open end, a substantially "L" shaped first flange element having one longer leg deployed on an outer face of said door plate, a shorter leg pivotally joined on a lip of said container and pinned to said follower bar.

4. The device of claim 3 wherein said shorter leg is pivotally joined to said lip by two spaced upstanding ears provided on said lip, said shorter leg disposed therebetween and a pivot pin extending therethrough.

5. The device of claim 4 including a second "L" shaped flange element parallel to said first flange element.

6. The device of claim 5 in which said parallel rods extend downwardly to provide legs and extremities of said rods are crossbraced.

7. The device of claim 6 in which a support base is pivotally conneced to said legs and has a U-shaped configuration open at said legs.

8. The device of claim 7 in which a stop element is provided on said support base near said legs to coact thereagainst.

9. The device of claim 8 in which a terminal portion of said plunger rod remote from said plunger plate, forms a handle.

* * * * *